United States Patent [19]

Lake

[11] 3,950,190

[45] Apr. 13, 1976

[54] RECOVERY-ANNEALED COLD-REDUCED PLAIN CARBON STEELS AND METHODS OF PRODUCING

[75] Inventor: Peter B. Lake, Boardman Township, Mahoning County, Ohio

[73] Assignee: Youngstown Sheet and Tube Company, Youngstown, Ohio

[22] Filed: Nov. 18, 1974

[21] Appl. No.: 524,745

[52] U.S. Cl. ..... 148/12 R; 148/12 C; 148/12 F

[51] Int. Cl.[2] ..... C21D 9/46

[58] Field of Search ..... 148/12 F, 12 C, 12 R

[56] References Cited

UNITED STATES PATENTS 2,814,578 11/1957 White ..... 148/12 D 3,591,427 7/1971 Hansen, Jr. ..... 148/12 D

*Primary Examiner*—W. Stallard

*Attorney, Agent, or Firm*—John Stelmah

[57] ABSTRACT

A plain carbon, cold-reduced flat rolled steel product with yield strengths in an intermediate range and exhibiting good ductility, as well as a method of processing to attain said yield strength and good ductility characteristics without reliance upon the purposeful addition of precipitation strengthening agents.

10 Claims, 6 Drawing Figures

RECOVERY-ANNEALED COLD-REDUCED PLAIN CARBON STEELS AND METHODS OF PRODUCING

BACKGROUND OF THE INVENTION

This invention relates to the production of plain-carbon steel having yield strength levels with attendant good ductility and weldability characteristics which, in combination, have not been economically attainable heretofore. More specifically this invention relates to the production of plain carbon steel having yield strengths in the range of 55 to 80 ksi (379–551 MPa), ductilities, as measured by percent of elongation in 2 inches (5.08 cm) of 25 to 10%, and the ease of weldability of other plain carbon steels.

With an increased emphasis in the automotive industry for pollution control and safety devices, there exists a desideratum for reducing the overall weight of automobiles. Such desideratum may be at least partially satisfied by providing means for maintaining or increasing the strength of steel components without adding to the overall weight. However, in order to accomplish this, the steel must also be capable of being readily formable into required configurations, some of which are rather complex, and also must be easily weldable to facilitate mass production. It is with this desideratum in mind that the present invention was developed.

DESCRIPTION OF PRIOR ART

It is known in the art that relatively low strength steels, those having yield strengths less than 55 ksi (379 MPa), with acceptable ductility can be produced by processing which includes recrystallization annealing. Such recrystallization annealing is conducted to improve the ductility characteristic; however, there is an attendant sacrifice in loss of strength. Processes are also known in the art for producing steel, with the addition of alloying agents, which have relatively high yield strengths, those greater than 55 ksi (379 MPa). There also exist other steels which do not include alloying agents and which exhibit strength levels greater than 80 ksi (551 MPa), however, these steels have minimal ductility levels, generally less than 10 percent.

In U.S. Pat. No. 3,492,173, Goodenow describes the processing of titanium-bearing steels having a titanium to carbon ratio greater than 4 to 1 and contends that: such steels are unique in that upon being processed as described, the percent elongation exhibited is approximately the same for any given tensile strength regardless of the annealing temperature; a particular tensile strength and percent elongation can be obtained either by a continuous recovery anneal or by a batch recovery anneal; thus a greater degree of flexibility in operating conditions is available when using these steels; and this property is absent in plain low-carbon rimmed or killed steels having no titanium or a titanium-carbon ratio less than about 4 to 1. In Goodenow's examples, the samples of hot rolled steel produced were reduced varying amounts between 50 and 85 percent by cold rolling.

From the Goodenow description, it is apparent that there exist significant limitations other than recovery annealing. Goodenow's processing requires the purposeful additions of a precipitation strengthening agent, such as titanium, in order to attain the contemplated yield strength levels. Further, the percentage of elongation attained by Goodenow is generally less than 10 percent.

OBJECTS AND SUMMARY OF THIS INVENTION

It is an object of this invention to provide flat-rolled steel products characterized by intermediate yield strength levels, i.e., 55 to 80 ksi (379–551 MPa), and ductilities of 25 – 10percent elongation and a method for producing such products.

It is another object of this invention to provide such steel products and methods for producing the same, without reliance upon purposeful additions of precipitation strengthening alloying agents, and which may include solution strengthening techniques.

It is a further object of this invention to provide a method of processing plain-carbon steel to an aim product having a preselected yield strength and good ductility.

Briefly, the present invention comprises the steps of cold-reducing, in the order of 10 to about 50 percent, a plain-carbon steel, of a composition which does not rely upon a purposely added precipitation hardening or strengthening agent, and thereafter recovery annealing the cold-reduced steel for a time and at a temperature such that 80 to 95 percent of the yield strength of the steel as-rolled will be retained; the degree of cold-reduction is preselected to provide a product having a yield strength in the order of 55 to 80 ksi (379–551 MPa) and attendant ductility of 25 to 10 percent, as measured by elongation in 2 inches (5.08cm).

In practicing the invention, slab steel of the following analysis is hot rolled and pickled by conventional commercial practices, to provide hot bands or strips having nominal thicknesses in the range of 0.060 to 0.160 inch (0.152 – 0.406 cm):

| | % by weight |
|---|---|
| Carbon (C) | 0.15 max. |
| Manganese (Mn) | 0.90 max., 0.60 preferred high |
| Phosphorus (P) | 0.040 max. |
| Sulfur (S) | 0.050 max. |
| Balance - essentially Iron (Fe) | |

It will be understood that the balance may include residual impurities, which impurities may include residues of killing agents. It is preferred that the total of the constituents, other than iron, not exceed 1.1 percent, by weight.

In producing the hot band it is preferred that a technique be employed which will provide a fine dispersion of spheroidal iron carbide particles in the steel, e.g. finish hot rolling at a temperature above 1550°F (843°C) and coiling at a temperature below 1150°F (621°C). The conventionally hot-rolled and pickled strips will typically exhibit yield strengths in the general range of 30 to 45 ksi (207 to 310 MPa) and elongations of 30 – 45 percent, in 2 inches (5.08 cm).

Optionally, when a relatively thin gage is required in the final product and the starting product is of a gage such that a single reduction will not provide the desired final gage and the desired final yield strength, the hot-band may be subjected to intermediate processing. Such intermediate processing may comprise a first cold-reduction (following the hot-rolling step and pickling) and recrystallization annealing step to provide a starting product for a second cold-reduction step followed by the recovery-annealing procedure of this invention. The steel, after the first cold-reduction and recrystallization annealing may exhibit yield strengths in the general range of 25 to 40 ksi (172 to 276 MPa).

The desired yield strength level and the chemistry of the steel to be processed will dictate the gage and degree of cold reduction of the starting product (just prior to the recovery annealing step). The general range of cold reduction, in the process of this invention, is in the order of 10 – 50 percent. The relationships amongst the yield strengths, steel chemistries, and the required cold-reduction will be more specifically described hereinafter.

DESCRIPTION OF PREFERRED EMBODIMENTS

Figure 1:
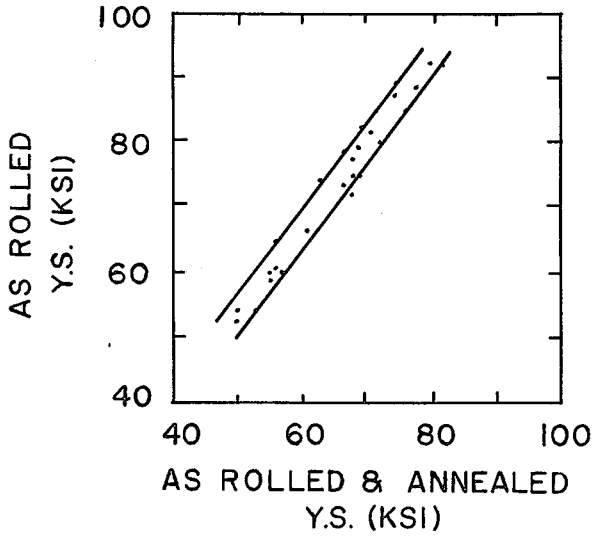
FIG. 1 is a diagrammatic representation of the relationships between the as-cold-rolled yield strengths and the yield strengths after special recovery annealing in accordance with this invention.

From the laboratory simulations and investigations of both batch and continuous annealing procedures and from the commercial operational procedures in accordance with this invention, the various relationships graphically depicted in FIGS. 1–6 were developed.

Additionally, an empirical formula has been developed whereby the as-rolled yield strength ($Y_{AR}$), which can be attained from the starting product (usually, but not necessarily hot band), can be reasonably predicted when the starting product is subjected to cold-reduction in the order of 10 to 50 percent. The relationship for the starting product yield strength ($Y_I$), the percent reduction (R), and the as-rolled yield strength which has been empirically developed may be expressed as:

$$Y_{AR} = Y_I - C_1 + \sqrt{C_2 + C_3R - R^2} + C_4\,(C.E.)$$

wherein:

$Y_{AR}$ = as-rolled yield strength (ksi)

$Y_I$ = starting product yield strength (ksi)

$R$ = % reduction or $$100 \times \frac{t_I - t_{AR}}{t_I}$$

$t$ = thickness $C_1$, $C_2$, $C_3$, and $C_4$ are empirical constants

C.E. = carbon equivalent (which may vary from 0.05 to 0.50 percent, by weight) or %C+0.2% Mn+%P It has been found that if the constants are assigned the respectively indicated numbers: $C_1 = 36$; $C_2 = 875$; $C_3 = 170$; and $C_4 = 60$, the actual value of the as-rolled yield strength can be predicted within ± 10%. Hence, the use of these constants provide a good basis for predicting the as-rolled yield strength. In some cases it may be found that the actual as-rolled yield strength value obtained will correspond more closely with the formula if one or more of the constants are adjusted within the following indicated ranges: $C_1 = 26$ to 46; $C_2 = 0$ to 2000; $C_3 = 120$ to 200; and $C_4 = 20$ to 100. There exists no established relationship amongst constants per se, i.e. if one constant is changed there is no necessary proportional change in any of the other constants.

For a given set of parameters and/or conditions, a more precise equation may be developed to fit a curve representing said set by varying one or more of the constants within the disclosed range. However, for the most part, and as a starting point for predicting the as-rolled yield strength with ±10 percent for steels which are cold-reduced 10 to 50 percent the procedure as described above will suffice.

Because there will occur a slight reduction in yield strength during the recovery anneal process, there must be an allowance made in determining the as-rolled strength which will provide the desired or aim resultant yield strength. It is within the contemplation of this invention to provide plain carbon steel which is "recovery-annealed," as opposed to steel subjected to annealing which results in recrystallization and as opposed to annealing which retains a "full-hard" product. From the work that has been conducted, it has been found that cold-reduced plain carbon steels which upon annealing recover less than 80 percent of their as-rolled yield strengths display some recrystallization. It will be recognized that as the yield strength recovery approaches 80 percent there may occur some evidence of the initiation of some recrystallization, i.e. there is no sharp threshold at 80 percent recovery for every type of steels. On the other hand, a full-hard steel may be defined as one which is cold-reduced and retains, after annealing 95 to 100 percent of its as-rolled yield strength. Thus, "recovery-annealed", as contemplated in some of the broad aspects of this invention, encompasses an anneal by which a cold-reduced plain carbon steel retains 80 to 95 percent of its as-rolled yield strength. For optimum ductility, at a given strength level, it is preferred to provide an anneal by which the steel will retain 80 to 90 percent of its as-rolled yield strength.

Figure 2:
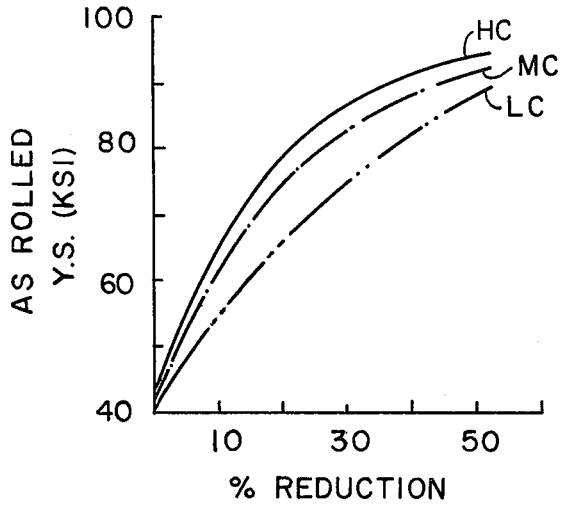
FIG. 2 is a diagrammatic representation of the cold-rolled yield strength (before anneal) to % reduction from hot band relationship for three different steel compositions.

The curves shown in FIGS. 1 and 2 were developed from tests conducted on specimens of steel cold-reduced to provide nominal reductions of 10, 20, 30, 40 and 50 percent.

The following TABLE I discloses some of the actual reductions made together with the yield strength (YS) and elongation (ELONG.) tests* on specimens in the as-cold-rolled and in the special recovery annealed, after cold-rolling conditions. Both sets of specimens were produced from a low-carbon-rim hot band having a yield strength of 39 ksi (269 MPa) and a 40 percent elongation.

* ASTM A-370-73 Standard Methods and Definitions for Mechanical Testing of Steel Products.

TABLE I

| REDUCTION | AS COLD-ROLLED | | | RECOVERY ANNEALED | | |
|---|---|---|---|---|---|---|
| % | YS KSI | YS MPa | % ELONG. | YS KSI | YS MPa | % ELONG. |
| 10 | 52 | 351 | 23 | 50 | 345 | 26 |
| 19 | 67 | 463 | 8 | 56 | 385 | 20 |
| 32 | 77 | 582 | 5 | 68 | 469 | 15 |
| 41 | 80 | 552 | 4 | 70 | 484 | 14 |
| 50 | 87 | 601 | 3 | 75 | 517 | 12 |

FIG. 2 shows the relationship between the cold-rolled yield strengths, prior to annealing, and percent reductions for three steels of different chemistries. For convenience, these steels are separately designated as low (LC), medium (MC), and high carbon (HC). The corresponding carbon and manganese contents, percent by weight, and the corresponding AISI number designations are shown in the following TABLE II.

TABLE II

| | %C | %Mn | AISI |
|---|---|---|---|
| Low carbon | .08 max<br>avg. .06 | .25–.40<br>avg. .30 | 1006 |
| Med. carbon | .08–.13<br>avg. .09 | .30–.60<br>avg. .45 | 1010 |
| High carbon | .10–.15<br>avg. .12 | .30–.60<br>avg. .50 | 1012 |

Figure 3:
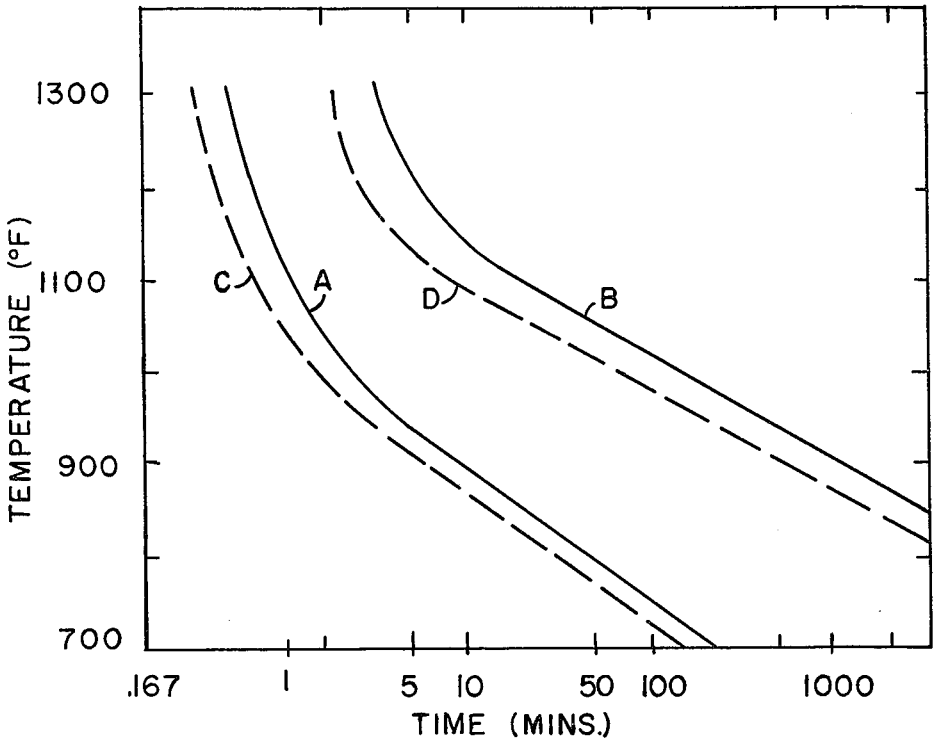
FIG. 3 is a diagrammatic representation of the time-temperature-relationships required to provide steels having yield strengths after annealing, which are 0.80 and 0.95 of the as-rolled yield strenghts for low-carbon steels which have been 40 and 20 percent cold-reduced.
Figure 4:
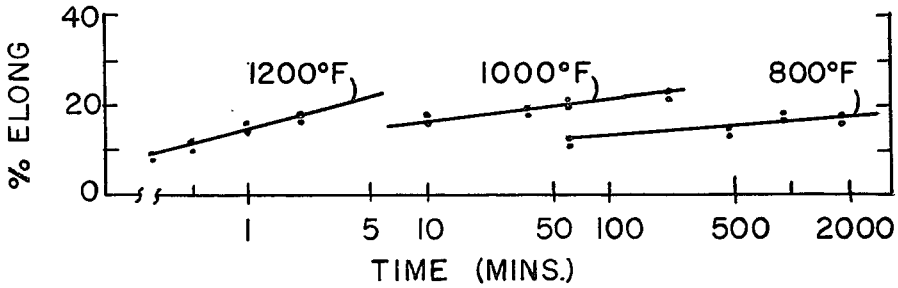
FIG. 4 is a graphic representation of the changes in % elongation which accompany changes in annealing time and/or temperature, of a 20 percent cold-reduced low-carbon steel.
Figure 5:
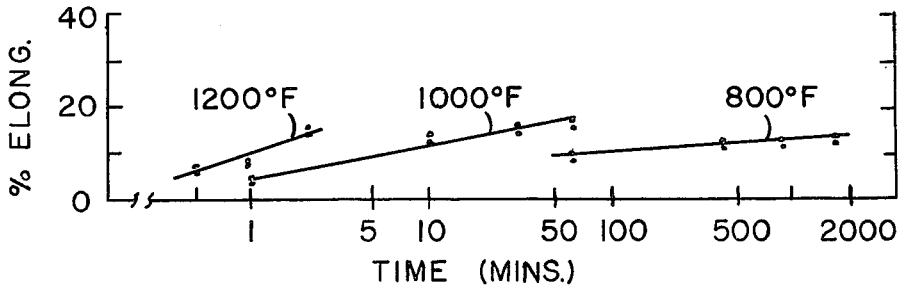
FIG. 5 is a graphic representation of the changes in % elongation which accompany changes in annealing time and/or temperature, of a 40 percent cold-reduced low-carbon steel.

FIG. 3, illustrates the "recovery-anneal" regions contemplated by this invention for low-carbon steels which have been cold-reduced 20 and 40 percent. Curve "A" is one for steels which have been reduced 20 percent and illustrates the time-temperature relationships which will produce strengths after anneal in the general order of 95 percent of the as-rolled yield strengths. Curve "B" illustrates the time-temperature relationships of steel which have been reduced 20 percent which will produce strengths after anneal in the general order of 80 percent of the as-rolled yield strengths. The area between Curves A and B represents the recovery-anneal time-temperature relationships of this invention. The region to the left of Curve A represents those time-temperature relationships which will provide a full hard product and the region to the right of Curve B represents relationships which will provide a product characterized by recrystallization.

Curves C and D represent relationships corresponding to curves A and B, respectively, but for a product which has been 40 percent reduced. The region between Curves C and D represents the recovery anneal area for 40 percent reduced steels. It will be understood that curves for reductions between 20 and 40 percent will fall intermediate the corresponding curves for 20 and 40 percent reductions.

Figure 6:
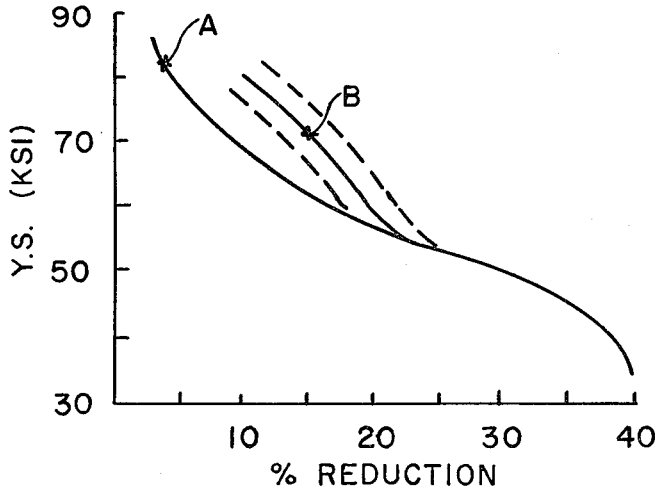
FIG. 6 (Sheet 1) is a graphic representation of the yield strength - % elongation relationship for a low carbon steel for the as-rolled condition and for the recovery annealed condition after rolling.

The transition in yield strength and % elongation which steels processed in accordance with this invention undergo may be readily observed by reference to FIG. 6. In FIG. 6 is graphically depicted the transition of a low carbon steel in the as cold-rolled state and displaying a yield strength in the order of about 81.5 ksi (562 MPa) and an elongation of about 4 percent, designated as point A on the curve. After recovery annealing in accordance with this invention, such steel will attain a yield strength in the general order of 71.5 ksi (493 MPa) and the capability of elongation will increase to a general order of 15 percent, designated as point B on the annealing band of curves. It will be observed that the reduction in yield strength from 81.5 ksi to 71.5 ksi (562 to 493 MPa) generally corresponds to the relationship illustrated in FIG. 1. From FIG. 2 it will be observed that in order to attain a cold-rolled yield strength (before annealing) of 81 ksi (562 MPa) a hot-band reduction of about 39 percent is required. It will then be further observed from FIG. 5, which depicts the time-temperature relationship for a 40 percent reduced steel and is sufficiently appropriate for a 39 percent reduced steel, that a 15 percent elongation characteristic in the annealed steel may be attained, for example by annealing the cold reduced steel at a temperature of 1200°F (649°C) for about 2.5 minutes or at a temperature of 1000°F (538°C) for about 35 minutes.

It will be observed that as the % of the cold reduction decreases there is an increase in the period of time which a cold-rolled sheet can be annealed to produce a non-recrystallized, non-full hard, but stress-relief annealed product. This provides greater latitude in processing and hence better opportunity for controlling the product physical qualities at lower cold reduction.

It will also be observed that with increased percentages of cold-reduction, the "nose" of the time-temperature curves moves toward the left, which movement represents a decrease in the time available to produce a recovery-annealed product. Thus, there is a trend such that with cold-reductions which generally exceed 50 percent, there is insufficient time available to suitably control the processing to produce a recovery-annealed product but instead leans toward one which displays significant recrystallization. While the thresholds cannot be precisely defined, because they will vary dependent upon carbon and/or other factors, it has been demonstrated that the recovery-anneal phenomenon for plain-carbon steels becomes increasingly difficult to attain as cold-roll reductions generally exceed 50 percent.

Assume for the purpose of illustration, that an aim product of 0.050 inch (0.127 cm) thickness and having a yield strength of 65 ksi (448 MPa) (±3 ksi) is desired. From FIG. 1, it can be determined that an intermediate product having an as-rolled yield strength in the order of 73 ksi (503 MPa) (±3 ksi) will be required. Reference to FIG. 2 indicates that such as-rolled product can be produced from a starting product of low carbon steel by a cold-reduction of 29% ± 3, or from a medium carbon steel product by a cold reduction of 18% ± 3, or from a high carbon steel by a cold-reduction of 15% ±3. Thus, the hot band thicknesses required for the low, medium, and high carbon steels would be generally in the order of 0.070, 0.062, and 0.058 inch (0.178, 0.157, and 0.147 cm), respectively.

After the steel is cold reduced to produce the preselected as-rolled yield strength, the steel is subjected to a recovery anneal treatment to regain a substantial degree of ductility. The thermal recovery anneal treatment may be described as one which does not produce recrystallization, but instead provides stress-relief to the as-rolled structure with a regain of ductility.

To demonstrate that this invention can be practiced in conjunction with batch type annealing or continuous annealing processing, the following examples of commercial processing that have been conducted are submitted.

CONTINUOUS ANNEALING — Rimmed bottle-top steels of the following chemical analysis, in percent by weight:

0.04 - 0.08 C, 0.22 - 0.36 Mn, 0.002 - 0.008 P, 0.010 - 0.026 S, with the balance being Fe, except for less than 0.10 percent residuals, were processed in conventional manner into hot bands having a nominal 0.105 inch (0.267 cm) thickness and a nominal width of 28.5 inches (72.4 cm). The normalized hot bands were hot mill finish rolled at about 1600°F (871°C), coiled at about 1050°F (566°C), and exhibited: yield strengths in the general order of 38 ksi (262 MPa), ultimate tensile strengths in the general order of 48 ksi (331 MPa), and tensile elongations in 2 inches (0.508 cm) of about 39 percent. Following pickling and side-trimming, the strips were cold-reduced about 34 percent, i.e. to a general range of 0.067 to 0.075 inch (0.170 to 0.191 cm). The as-rolled (AR) properties exhibited were: yield strengths, longitudinal 77 to 85 ksi (531 to 586 MPa), transverse 82 to 90 ksi (565 to 620 MPa); ultimate tensile strengths, longitudinal 78 to 86 ksi (537 to 593 MPa), transverse 82 to 90 ksi (565 to 620 MPa); tensile elongation in 2 inches (0.508 cm), longitudinal 4 to 6 percent, transverse 5 to 9 percent; and hardness ($R_B$) 86 to 90.

The cold reduced strips were then continuously annealed on a galvanizing line at an effective average temperature in the range of 1025° to 1125°F (552° to 602°C) for an effective average dwell time of 0.5 to 2.5 minutes; cooled to below 150°F (66°C) at an average rate of 200 F°/min. (111 C°/min.), ± 100 F°/min. The annealed strips exhibited the following properties: yield strengths, longitudinal 65.2 to 73.6 ksi (449 to 507 MPa), transverse 72.7 to 80.3 ksi (501 to 553 MPa); ultimate tensile strengths, longitudinal 71.2 to 80.8 ksi (491 to 557 MPa), transverse 77.9 to 84.9 ksi (537 to 595 MPa); elongation in 2 inches (5.08 cm), longitudinal 15.5 to 19.5 percent, transverse 10.5 to 16.5 percent; and hardness ($R_B$) 84 to 90.

BATCH ANNEALING — Rimmed steels of the following chemical analyses, in percent by weight, 0.02 to 0.08C, 0.26 to 0.38 Mn, 0.004 to 0.008 P, 0.016 to 0.026 S with the balance being Fe, except for less than 0.10 percent residuals, were processed in conventional manner into hot bands having a nominal 0.100 inch (0.254 cm) thickness and a nominal width of 37 inches (94 cm). The hot bands were hot mill finish-rolled at about 1600°F (871°C), coiled at about 1050°F (566°C) and exhibited: yield strengths in the general order of 35.5 ksi (245 MPa) ultimate tensile strengths in the general order of 47.5 ksi (327 MPa), and tensile elongations in 2 inches (5.08 cm) of about 39 percent. Following pickling and side trimming, the strips were cold reduced about 32 percent, i.e. to a general range to 0.066 to 0.072 inch (0.168 to 0.183 cm). The as-rolled properties exhibited were: yield strengths, longitudinal 78.4 to 84.4 ksi (540 to 582 MPa), transverse 84.6 to 92.6 ksi (583 to 638 MPa); ultimate tensile strengths, longitudinal 78.7 to 84.7 ksi (542 to 584 MPa) transverse 90.1 to 98.1 ksi (621 to 676 MPa); tensile elongation in 2 inches (5.08 cm), longitudinal 3.5 to 5.5 percent, transverse 3.0 to 5.0 percent; and hardness ($R_B$) 85 to 89.

The cold-reduced strips were then subjected to a batch anneal in which the coils were slowly heated to 850°F, ±50°F (454°C), such that the temperature was increased at an average rate of about 50F°/hr (28C°), and then held for a 14 hour soak period, before slowly cooling to room temperature. The annealed strip exhibited the following properties: yield strengths, longitudinal 61.1 to 73.9 ksi (421 to 509 MPa), transverse 68 to 82.3 ksi (469 to 567 MPa); ultimate tensile strengths, longitudinal 66.8 to 80.8 ksi (460 to 557 MPa), transverse 72.2 to 90 ksi (497 to 620 MPa); elongation, longitudinal 16 to 20 percent, transverse 10 to 16 percent, and hardness ($R_B$) 82 to 89. The strips were then temper-rolled; this produced an extension of about 0.5 percent, an increase in yield and tensile strengths of generally 3 ksi (21 MPa), and a decrease in ductility of 0 to 2 percent (elongation).

The present invention demonstrates that, contrary to previously held notions, a high degree of flexibility in operating conditions is available when processing plain-carbon rimmed or killed steels, without reliance upon purposeful additions of agents in amounts which significantly contribute to precipitation type strengthening characteristics, in the production of intermediate yield strength grade steels which possess good ductility. The intermediate yield-strength grades of plain-carbon steels are made available by subjecting steels to cold-reductions of 50 percent, or less, which reductions are generally below those which will produce higher strengths, i.e., greater than 80 ksi (551 MPa), but which permit longer times for recovery annealing and hence better opportunities for processing control.

What is claimed is:

1. A method of treating plain carbon steel to provide a non-full hard steel strip without substantial recrystallization, said steel having no agents purposely added to contribute significantly to precipitation strengthening, comprising:

cold reducing said steel in the order of 10 to 50%, and recovery annealing the cold-reduced steel at a temperature and for a time such that will provide a yield strength in the range of 55 to 80 ksi (379-551 MPa) and increase its ductility to at least 10%, as measured by percent longitudinal elongation.

2. A method as described in claim 1, wherein:

the total of the constituents, other than iron, does not exceed 1.1 percent of the total weight.

3. A method as described in claim 1, wherein:

the composition of said steel consists essentially of, percentage by weight, 0.02 to 0.15% carbon, 0.90% max. manganese, 0.04% phosphorus, 0.05% sulphur, and the balance being essentially iron and residual impurities.

4. A method of treating plain carbon steel composition, to provide a non-full hard strip which includes solution strengthening but which composition is free of a purposely added amount of agent which contributes to precipitation strengthening, which method comprises the steps of:

a. hot-rolling steel of said composition in a manner which will produce a fine dispersion of spheroidal iron carbide particles in the resultant strip;

b. cold reducing said strip in the order of 10 to 50 percent such that will develop a yield strength in the order of 105 to 125 percent of a desired aim product yield strength range of 55 to 80 ksi (379 to 552 MPa); and c. recovery annealing the cold-reduced strip at a temperature and for a time such that the steel will retain a yield strength, without causing recrystallization to occur, within said aim product yield strength range and to regain ductility.

5. A method as described in claim 4, which further comprises: subjecting the hot-rolled steel of step (a) to a cold-reduction and recrystallization annealing procedure prior to conducting step (b).

6. A method of treating a steel composition containing, percent by weight, 0.02 to 0.15% carbon, a maximum of 0.90 manganese, a maximum of 0.040 phosphorous, a maximum of 0.050 sulphur, with the balance being essentially iron, with residual impurities, and being free of purposely added alloying agents in amounts which results in precipitation hardening, which method comprises:

a. hot-rolling to a finishing temperature above 1550°F and coiling at a temperature below 1150°F to produce in the resultant hot-band strip a fine dispersion of spheroidal iron carbide particles;

b. cold-reducing said hot-band strip at a rate of 10 to 50 percent and thereby develop a yield strength in the order of 105 to 125 percent of the aim product yield strength; and c. recovery annealing the cold reduced strip at a temperature and for a time sufficient for the steel to recover 80 to 95 percent of the as-rolled yield strength attained in step (b) above.

7. A method of treating plain carbon steel, to provide a non-full hard strip, without substantial recrystallization, comprising:

cold-reducing said steel having a starting product yield strength to produce a product having an as-rolled yield strength in accordance with the formula:

$$Y_{AR} = Y_I - C_1 + \sqrt{C_2 + C_3R - R^2} + C_4\,(\text{C.E.})$$

wherein:

$Y_{AR}$ = as-rolled yield strength (ksi)

$Y_I$ = starting product yield strength (ksi)

$$R = \%\ \text{reduction} = 100 \times \frac{t_1 - t_{AR}}{t_1}$$

where $t_1$ = thickness of starting product $t_{AR}$ = thickness of product after cold-rolling $C_1$ = 26 to 46

$C_2$ = 0 to 2000

$C_3$ = 120 to 220

$C_4$ = 20 to 100 and

*C.E.* = carbon equivalent = % C + .2% Mn + %P where % is by weight.

8. The method aS described in claim 7, wherein: $C_1 = 36$; $C_2 = 875$; $C_3 = 170$; $C_4 = 60$ and C.E. = 0.05 to 0.50 percent.

9. The method as described in claim 7, which further comprises: recovery annealing the cold-reduced product to provide an end-product having a final yield strength which is 0.80 – 0.95 $Y_{AR}$.

10. A cold-reduced recovery annealed plain carbon steel being less than full-hard and having a composition consisting essentially of, percentage by weight:

0.02 to 0.15% carbon, and maximums of 0.90% manganese, 0.040% phosphorus, 0.050% sulfur, the balance being iron, and residual impurities, said steel being characterized by a yield strength of 55 to 80 ksi (379 to 552 MPa) and a ductility of at least 10 percent elongation.

* * * * *

UNITED STATES PATENT OFFICE

CERTIFICATE OF CORRECTION

Patent No. 3,950,190 Dated April 13, 1976

Inventor(s) Peter B. Lake

It is certified that error appears in the above-identified patent and that said Letters Patent are hereby corrected as shown below:

In Figure 6 of the drawing, "% Reduction" should read ---% Elongation---.

Column 4, line 29, insert --- yield --- after "as-rolled".

Column 6, line 33, insert --- content --- after "carbon".

Signed and Sealed this

Fourteenth Day of September 1976

[SEAL]

*Attest:*

RUTH C. MASON
*Attesting Officer*

C. MARSHALL DANN
*Commissioner of Patents and Trademarks*